United States Patent [19]

Hayashi et al.

[11] 4,364,404

[45] Dec. 21, 1982

[54] INVENTORY DEVICE IN AUTOMATIC VENDING MACHINE

[75] Inventors: Yukichi Hayashi; Masauuki Tamura; Osamu Sugimoto, all of Sakado; Masayoshi Takizawa, Kitamoto; Tatsujiro Nishioka, Yokohama; Masaki Akagawa, Sakado; Yutaka Yokohda, Niiza, all of Japan

[73] Assignee: Kabushiki Kaisha Nippon Coicno, Tokyo, Japan

[21] Appl. No.: 197,212

[22] Filed: Oct. 15, 1980

[51] Int. Cl.[3] ..... G07D 1/00

[52] U.S. Cl. ..... 133/4 A; 221/93; 221/110

[58] Field of Search ..... 194/1 R, 1 N, 2, 10; 133/1, 2, 4, 8; 221/2, 7, 8, 9, 13, 92, 93, 110, 112, 114, 123, 124, 129, 126; 235/92 AC, 92 CN, 92 FP

[56] References Cited

U.S. PATENT DOCUMENTS

| | | | |
|---|---|---|---|
| 3,151,721 | 10/1964 | Westerhaus et al. | 221/7 X |
| 3,446,327 | 5/1969 | Auerbach et al. | 194/2 |
| 3,896,915 | 7/1975 | Hayashi et al. | 194/1 N |
| 4,146,778 | 3/1979 | Wain | 133/8 R X |
| 4,210,801 | 7/1980 | Gomez et al. | 235/92 CN |

*Primary Examiner*—F. J. Bartuska

*Attorney, Agent, or Firm*—Cushman, Darby & Cushman

[57] ABSTRACT

An inventory device which is used for a route-man to take all the coins out of the coin containing cylinders of an automatic vending machine. With the inventory device, the coin containing cylinders are caused one after another to dispense the coins merely by operating a single switch. The inventory device comprises: the single switch; a shift register; and a coin dispensation control section connected to the bit output of the shift register. The signal "1" is successively shifted in the shift register in response to the operation of the single switch, to operate the coin dispensation control section, thereby to dispense the coins out of the coin containing cylinders.

4 Claims, 8 Drawing Figures

| PERIOD | DI | $SD_1$ | $SD_2$ | $SD_3$ | $SD_4$ | $SD_5$ | $SD_6$ | $SD_7$ |
|---|---|---|---|---|---|---|---|---|
| $T_0$ | 0 | 1 | 1 | 1 | 1 | 1 | 1 | 1 |
| $T_1$ | 1 | 0 | 1 | 1 | 1 | 1 | 1 | 1 |
| $T_2$ | 1 | 1 | 0 | 1 | 1 | 1 | 1 | 1 |
| $T_3$ | 1 | 1 | 1 | 0 | 1 | 1 | 1 | 1 |
| $T_4$ | 1 | 1 | 1 | 1 | 0 | 1 | 1 | 1 |
| $T_5$ | 1 | 1 | 1 | 1 | 1 | 0 | 1 | 1 |
| $T_6$ | 1 | 1 | 1 | 1 | 1 | 1 | 0 | 1 |
| $T_7$ | 1 | 1 | 1 | 1 | 1 | 1 | 1 | 0 |

INVENTORY DEVICE IN AUTOMATIC VENDING MACHINE

BACKGROUND OF THE INVENTION

This invention relates to an inventory device which is used to take all the coins out of the coin containing cylinders of an automatic vending machine thereby to determine the number of coins, accordingly the amount of money, which has remained in the coin containing cylinder.

An automatic vending machine is provided with an inventory switch which is operated to dispense all the coins out of its coin containing cylinders to determine the number of coins which have maintained therein. A route-man who wants to receive the coins from the automatic vending machine, depresses the inventory switch to cause the coin containing cylinders to dispense the coins.

In a conventional automatic vending machine, such an inventory switch is provided for each of the coin containing cylinders. For instance, in the case of an automatic vending machine having a plurality of coin containing cylinders such as a 10-yen coin containing cylinder, a 50-yen coin containing cylinder, an auxiliary 10-yen coin containing cylinder and an auxiliary 50-yen coin containing cylinder, all of the inventory switches provided for the coin containing cylinders must be depressed one after another to cause the cylinders to dispense the coins. Accordingly, the operation is troublesome for the route-man. If the automatic vending machine has a number of coin containing cylinders, then he may sometimes forget to depress some of the inventory switches, thus leaving the coins in some of the coin containing cylinders, with the result that he makes an erroneous inventory. In this case, for instance, his account for the amount of money of the coins received from the automatic vending machine will not tally.

Furthermore, the number of inventory switch must be equal to the number of coin containing cylinders, and accordingly the switching mounting space is increased as much; that is, the size of the inventory device is increased as much, with the result that the manufacturing cost is also increased.

SUMMARY OF THE INVENTION

Accordingly, a primary object of this invention is to provide an inventory device in which the operation of one inventory switch causes a plurality of coin containing cylinders to dispense the coins.

Another object of the invention is to provide an inventory device in which whenever a single inventory switch is operated, a plurality of coin containing cylinder are specified one at a time to dispense the coins.

A further object of the invention is to provide an inventory device in which after a coin containing cylinder is specified by one operation of a single inventory switch, the coin containing cylinder is automatically switched over to another one.

The novel features which are considered characteristic of this invention are set forth in the appended claims. This invention itself, however, as well as other objects and advantages thereof will be best understood by reference to the following detailed description of illustrative embodiment, when read in conjunction with the accompanying drawings.

A still further object of the invention is to provide an inventory device in which, after the coin dispensation of one coin containing container has been completely achieved, the coin dispensation of another coin containing container is carried out.

BRIEF DESCRIPTION OF THE DRAWING

In the accompanying drawings.

DETAILED DESCRIPTION OF THE INVENTION

Figure 1:
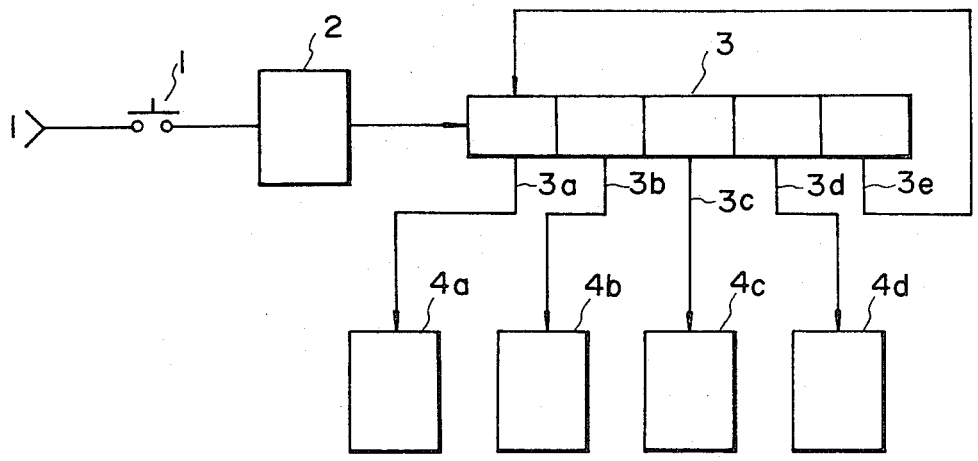
FIGS. 1 through 3 are block diagrams showing examples of an inventory device in an automatic vending machine, according to this invention.

One example of an inventory device according to this invention is as shown in FIG. 1. Whenever an automatic return type inventory switch 1 is depressed and released, a fall detection circuit 2 generates a pulse, so that a signal "1" is provided successively at the output lines 3*a* through 3*e* of a shift register 3. Coin delivering sections 4*a* through 4*d* operate to control the delivering of coins out of coin containing cylinders A through D, respectively. Each of the coin delivering sections 4*a* through 4*d* has a coin delivering motor and a motor drive circuit. When the signal "1" is applied through the line 3*a* to the coin delivering section 4*a*, the motor is driven so that all of the coins in the respective coin containing cylinder are delivered out. The operations of the remaining coin delivering sections 4*b* through 4*d* are the same as that of the coin delivering section 4*a* described above. Accordingly, the coins are delivered out of all the coin containing cylinders A through D merely by repeatedly operating one inventory switch 1. Instead of the fall detecting circuit 2, a rise detecting circuit can be similarly used.

Figure 2:
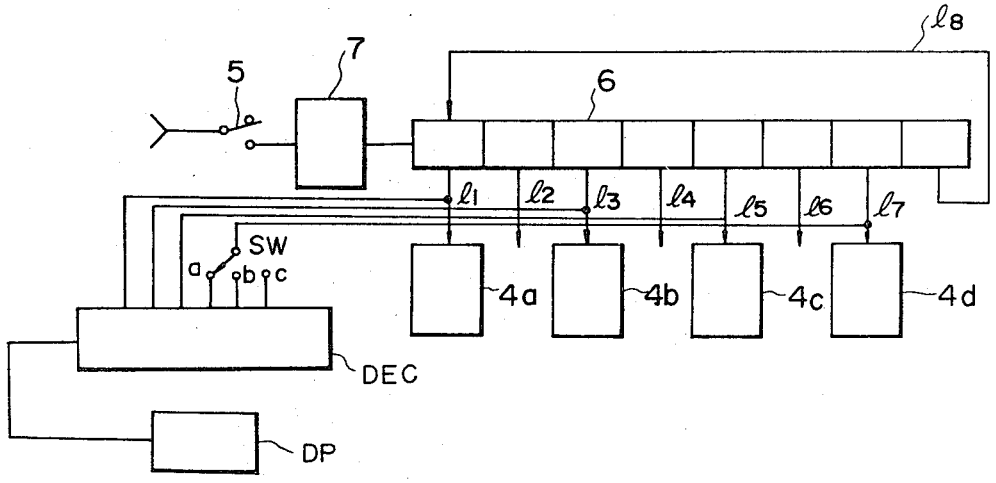

Another example of the inventory device according to the invention is as shown in FIG. 2. In the example, a manual return type switch 5 is employed instead of the automatic return type switch 1 in FIG. 1, a rise and fall detecting circuit 7 is used instead of the fall detecting circuit 2 in FIG. 1, and an 8-stage shift register 6 is employed instead of the shft register 3 in FIG. 1. The stage outputs of the shift register 6 are alternately applied to the coin delivering sections 4*a* through 4*d*, in order to prevent erroneous operations which may be caused by the chattering of the inventory switch 5.

Whenever the inventory switch 5 is operated (on and off), more specifically whenever the switch 5 is turned on, the signal "1" of the shift register 6 is shifted to lines $1_1$, $1_3$, $1_5$ and $1_7$ in the stated order. Accordingly, similarly in the above-described case, the coins are delivered out of the coin containing cylinders.

It goes without saying that in examples shown in FIGS. 1 and 2, the signal "1" has been loaded in the last stage of the shift register (3 or 6) before the inventory switch is depressed (or operated).

Figure 3:
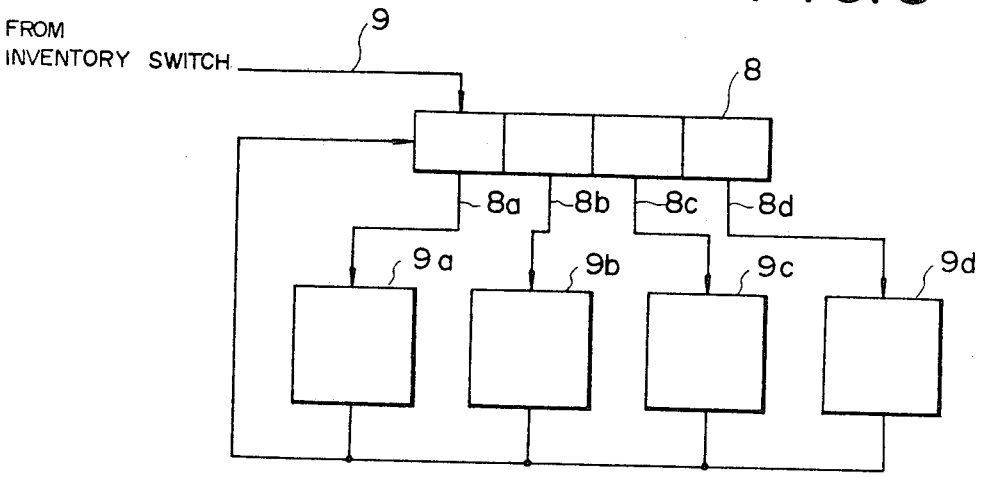

FIG. 3 shows a third example of the inventory device according to the invention. In the Example, a signal from the inventory switch (not shown) is used to load a signal "1" into a shift register 8, and the shifting of the signal in the shift register 8 is carried out with the aid of coin delivery completion signal provided by coin delivering sections 9*a* through 9*e*. Thus, the coin delivering section 9*a* is operated by the signal "1" provided at the line 8*a* of the shift register 8, and applies the coin delivery completion signal to the register 8 when the coin delivery has been accomplished. As a result, the signal "1" is shifted to the line 8*b* in the shift register 8, and therefore the coin deliverying section 9*b* is similarly operated. The operation of the remaining coin deliverying sections 9*b* through 9*d* are the same as that of the coin deliverying section 9*a* described above.

Referring back to FIG. 2, the outputs on the lines $1_1$, $1_3$, $1_5$ and $1_7$ are applied to a decoder DEC, the output of which is applied to a display unit DP. This is to display a coin deliverying section which is in operation at present. For instance in the case where the coin delivering sections 4*a*, 4*b* and 4*c* operate to deliver coins out of 10-yen, 50-yen and 100-yen coin containing cylinders, respectively and the remaining coin delivering section 4*d* is provided for a change-over coin containing cylinder or an auxilairy coin containing cylinder, the lines $1_1$, $1_3$ and $1_5$ are connected to 10-yen, 50-yen and 100-yen input terminals of the decoder DEC, respectively, and the line $1_7$ is connected to a switch SW having terminals a, b and c which are connected to the 10-yen, 50-yen and 100-yen input terminals of the decoder DEC. The armature of the switch SW is tripped according to the denomination of the coins in the coin containing cylinder which is in operation.

In the case when the output is provided on the line $1_3$ and accordingly the coin delivering section 4*b* is operated, the output on the line $1_3$ is applied to the decoder DEC, where it is decoded, and the resultant signal is displayed on the display unit DP, to indicate the fact that the 50-yen coin containing cylinder is delivering the coins.

Figure 4:
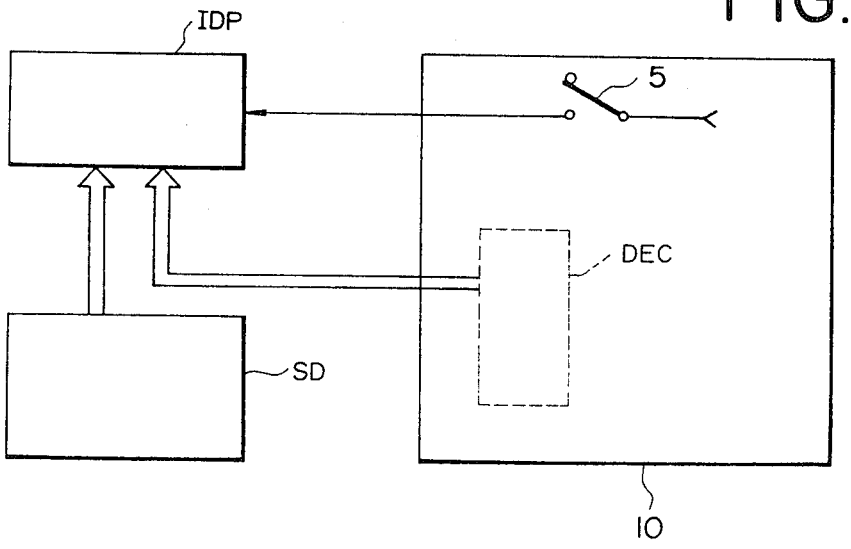
FIG. 4 is a block diagram showing another example of the inventory device according to the invention, in which the display unit of the inventory device is used commonly as the display unit of the automatic vending machine.

Similarly as in the above-described case, display means can be provided in an inventory device for an automatic vending machine having a number of coin containing cylinders such as main coin containing cylinders, change-over coin containing cylinders and auxiliary coin containing cylinders. However, for the coin containing cylinder such as a change-over coin containing cylinder or auxiliary coin containing cylinders in which the denomination of coins is not predetermined, the corresponding output of the shift register should be applied through a switch to the decoder as shown in FIG. 4.

In FIG. 2, the display unit DP is provided for the inventory device only; however, it may be used also as a display means IDP for displaying the contents of a addition/subtraction counter SD in an automatic vending machine. In this case also, the display means IDP displays the output of the decoder DEC when the inventory switch 5 is turned on in the inventory device 10.

Figure 5:
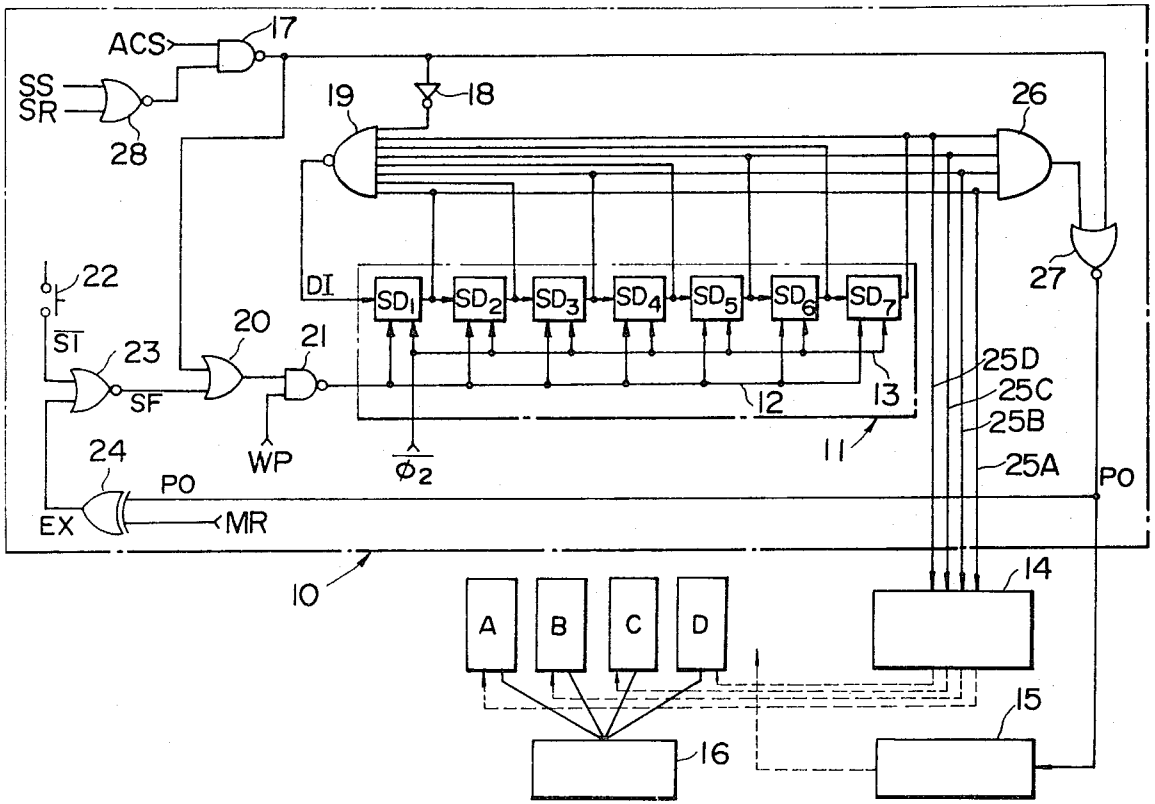
FIG. 5 is a circuit diagram, partly as a block diagram, showing one concrete example of the inventory device according to the invention.

Another example of the inventory device according to the invention is as shown in FIG. 5. This inventory device 10 is provided in association with a changer section (not shown) in an automatic vending machine. The inventory device 10 comprises a 7-stage shift register (or a sequence circuit such as a ring counter) 11 which is made up of flip-flops (more specifically static delayed flip-flops) SD1 through SD7 which are cascade-connected. When a signal on a load control line 12 is at "0", each flip-flop stores its input data. The data thus stored is read out in response to a clock pulse $\overline{\phi}_2$ (FIG. 6,(*a*)) on a read control line 13.

In this example, four coin containing cylinders A through D are provided. The first stage (or the flip-flop SD1) of the shift register 11 corresponds to the coin containing cylinder A, the third stage (or the flip-flop SD3) corresponds to the coin containing cylinder B, the fifth stage (or the flip-flop SD5) corresponds to the coin containing cylinder C, and the seventh stage (or the flip-flop SD7) corresponds to the coin containing cylinder D. In other words, the stages of the shift register 11 correspond alternately to the coin containing cylinders. For instance, the coin containing cylinders A and B receive 10-yen coins and 50-yen coins, respectively, and the coins therein are used as change coins. The coin containing cylinders C and D are auxiliary coin containing cylinders, and the coins therein are transferred into the coin containing cylinders A and B when the number of coins in the latter become short.

A dispensation switching unit 11 operates to select the coin containing cylinders A through D from which the coins are to be dispensed, according to the outputs of the first, third, fifth and seventh stages of the shift register 11. A coin dispensing motor 15 is provided commonly for the coin containing cylinders A through D. When the motor 15 is operated, coins are dispensed out of the coin containing cylinder only (being one of the cylinders A through D) which has been selected by the dispensation switching unit 14. A dispensed coin detecting section 16 operates to detect the coins which have been dispensed out of the coin containing cylinders A through D.

In the initial state, all the stage of the shift register 11 have data "1", and accordingly none of the coin containing cylinders are selected. In this connection, it should be noted that in the shift register 11 the logical level "0" is active.

Figures 6, 7:
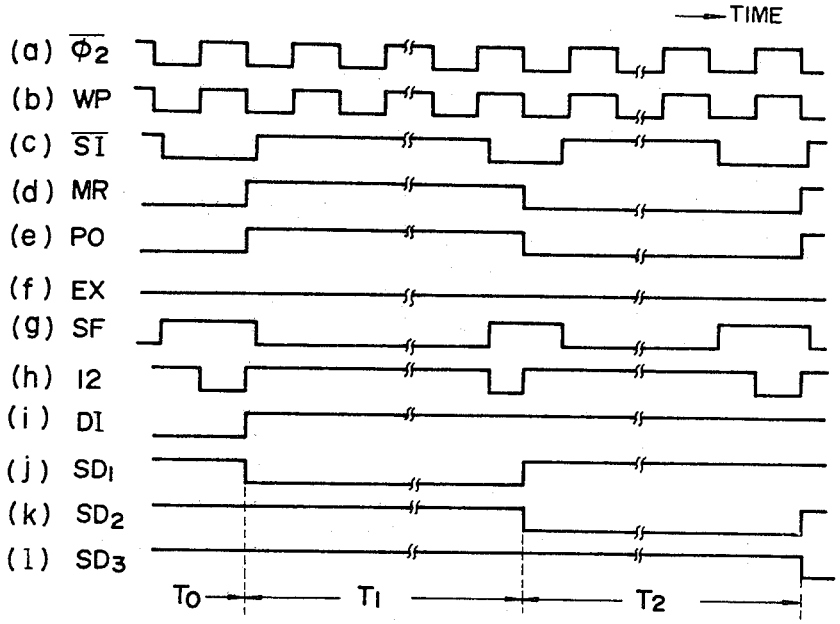
FIG. 6 is a time chart showing various waveforms in the circuit shown in FIG. 5.
FIG. 7 is a table for a description of the operation of a shift register in FIG. 5.

When the power switch of the automatic vending machine is turned on, an auto-clear signal $\overline{ACS}$ is provided (being at "0"), and therefore the output of a NAND circuit 17 is raised to "1". The output "1" of the NAND circuit 17 is inverted by an inverter 18 into a signal "0", which is applied to a NAND circuit 19. Therefore, the output of the NAND circuit 19 is raised to "1". This output of the NAND circuit 19 is an input data to the first stage of the shift register 11. The output "1" of the NAND circuit 17 is further applied through an OR circuit 20 to one input terminal of a NAND circuit 21, to the other input terminal of which a working pulse WP as indicated in the part (b) of FIG. 6 is applied. The time width of generation of the auto-clear signal $\overline{ACS}$ is longer than seven periods of the working pulse WP. Accordingly, during the generation of the auto-clear signal $\overline{ACS}$, the condition of the NAND circuit 21 is satisfied at least seven (7) times with the timing of the working pulse WP, and therefore the NAND circuit 21 outputs at least seven pulse signals, "0". The output of the NAND circuit 21 is connected to the load control line 12. Therefore, when the NAND circuit 21 outputs the first signal "0", the signal "1" from the NAND circuit 19 is loaded into the first stage (SD1) of the shift register 11. When the NAND circuit 21 outputs the second signal "0", the signal "1" stored in the first stage (SD1) is shifted to the second stage (SD2) while the signal "1" from the NAND circuit 19 is loaded into the first stage (SD1) again. In the above-described manner, the signals "1" are successively loaded into all the stages (SD1 through SD7). Thus, when the NAND circuit 21 outputs the seventh signal "0", all the stages (SD1 through SD7) have the signals "1"; that is, the shift register 11 is cleared. As was described above, the level "0" is active in the shift register 11, and therefore when all the stages have the signals "1", the shift register 11 is cleared (or reset). Thus, the state of the shift register 11 has been returned to its initial state in which all the data stored therein are at "1".

The inventory device 10 has one inventory switch 22. The inventory switch 22 is preferably a self-returning type switch; however, it may be manual return type switch. In the case where it is required to dispense all the coins out of the coin containing cylinders A, B, C, and D, the inventory switch 22 is operated to produce a pulsive inventory signal SI.

When the inventory switch 22 is first operated, the inventory signal SI is set to "0" (FIG. 6(*c*)) and is then applied to one input terminal of a NOR circuit 23, to the other input terminal of which the output EX of an EXCLUSIVE OR circuit 24 is coupled. A motor rotation signal MR is applied to one input terminal of the EXCLUSIVE OR circuit 24, to the other input terminal of which a coin dispensation instruction signal PO is applied. The motor rotation signal MR is raised to "1" when the motor 15 is turned, and it is set to "0" when the motor 15 is stopped. The coin dispensation instruction signal PO is raised to "1" when the coin dispensing motor 15 is instructed to turn, and it is set to "0" when the motor 15 is not instructed to do so. At the beginning, both of the signals MR and PO are at "0" (cf. FIG. 6,(*d*) and (*e*)), the therefore the output signal EX of the EXCLUSIVE OR circuit 24 is at "0" (FIG. 6(*f*)). Accordingly, the output signal SF of the NOR circuit 23 is raised to "1" in response to the inventory signal $\overline{SI}$ (FIG. 6,(*g*)).

The output "1" of the NOR circuit 23 is applied through the OR circuit 20 to the NAND circuit 21. When the level of the working pulse WP is increased to "1", the condition of the NAND circuit 21 is satisfied, so that the signal "0" is introduced from the NAND circuit 21 to the load control line 12 (FIG. 6,(*h*)). Accordingly, the shift register 11 is placed in loadable state, and the data stored in the stages SD1 through SD7 of the shift register 11 are all at "1" (that is, the shift register 11 being in clear state), as shown in the column "period $T_0$" of FIG. 7. As the outputs of the NAND circuit 17 is normally at "0", the output of the inverter 18 is at "1". Thus, the condition of the NAND circuit 19 is satisfied. Therefore, the output of the NAND circuit 19, i.e. the input data DI to the first stage SD1 of the shift register 11 is at "0" (FIG. 6,(*i*)). Thus, when the signal on the load control line 12 is set to "0" during the period $T_0$, the data DI at "0" is loaded into the first stage SD1 of the shift register 11, and the outputs "1" of the first through sixth stages are loaded into the second through seventh stages, respectively. The data loaded in the stages of the shift register 11 are read out in synchronization with the timing when the clock pulse $\phi_2$ falls to "0".

The data shifting operation of the shift register 11 is controlled by the signal on the load control line 12. Therefore, the data indicated in the column "period $T_1$" of FIG. 7 are held in the stages SD1 through SD7 of the shift register 11 until the signal on the line 12 is set to "0". That is, in this case, the output of the first stage SD1 is at "0", and the output of the remaining stages SD2 through SD7 are at "1". The output "1" of the first stage SD1 is applied through a line 25A to the dispensation switching unit 14, to dispense coins from the coin containing cylinder A. At the same time, the output of an AND circuit 26 to which the outputs of the first, third, fifth and seventh stages of the shift register 11 are applied is set to "0". The outputs "0" of the AND circuit 26 and the NAND circuit 17 are applied to a NOR circuit 27, and therefore the output PO (coin dispensation instruction signal) of the NOR circuit 27 is raised to "1". The coin dispensation instruction signal PO is applied to the coin dispensing motor 15 to turn the latter 15, as a result of which the coins are dispensed out of the coin containing cylinder A.

For the period $T_1$ during which the signe signal "0" is held in the first stage SD1 of the shift register 11, the coin dispensation instruction signal PO is maintained produced, and the motor 15 is continuously turned to successively dispense the coins out of the coin containing cylinder A. Even after all the coins are dispensed out of the cylinder A, the motor 15 is maintained turned as long as the data in the shift register 11 is maintained unchanged.

The coin dispensing operation can be stopped by depressing the inventory switch 22 again. In this case, in order to make the operation of the inventory switch 22 effective, it is necessary that the condition of the EXCLUSIVE OR circuit 24 is satisfied; that is, it is required that the coin dispensation instruction signal PO is provided (being at "1") and the coin dispensing motor 15 is turned (the motor rotation signal MR being at "1").

In the normal operation, during the period $T_1$ both of the coin dispensation instruction signal PL and the motor rotating signal MR are at "1", and therefore the output of the EXCLUSIVE OR circuit 24 is at "0". Therefore, when the inventory signal $\overline{SI}$ is set to "0" by the operation of the inventory switch 22, the output SF of the NOR circuit 23 is raised to "1", and the output "1" of the NOR circuit 23 is applied through the OR circuit 20 to the NAND circuit 21. When the working pulse WP is raised to "1", the output of the NAND circuit 21 is set to "0", and one shifting operation is carried out in the shift register 11; that is, the signal "0" hold in the first stage SD is shifted into the second stage SD2, while the signals "1" are loaded into the first stage SD1 and the third through seventh stages SD3 through SD7, respectively. Accordingly, with the timing of the next clock pulse $\overline{\phi_2}$ the contents of the output data of the stages SD1 through SD7 of the shift register 11 are as indicated in the column "period $T_2$" in FIG. 7. Thus, only the second stage SD has the signal "0" (FIG. 6,(*k*)). However, it should be noted that the output signal of the second stage SD is not supplied to the AND circuit 26 and the dispensation switching unit 14. Therefore, the coin dispensation instruction signal is set to "0", and the motor 15 is stopped. Furthermore, none of the cylinders A through D are selected by the dispensation switching unit. Thus, the coin dispensing operation is suspended once.

In dispensing the coins out of the coin containing cylinder B, the inventory switch 22 is operated again. In the coin dispensation, under the condition that the coin dispensing operation has been suspended the operation of the inventory switch 22 becomes effective. That is, when both the coin dispensation instruction signal PO and the motor rotation signal MR are at "0", the output of the EXCLUSIVE OR circuit is at "0". When, under this condition, the inventory switch 22 is operated, the output SF of the NOR circuit 23 is raised to "1", and the shifting operation is effected in the shift register 11 with the timing of the working pulse WP. As a result, the single signal "0" is shifted from the second stage SD2 to the third stage SD3, and the first, second, fourth, fifth, sixth and seventh stages have the signals "1" as indicated in the column "period $T_3$" in FIG. 7. The output signal "0" of the third stage SD3 is supplied to the AND circuit 26 and through a line 25B to the dispensation switching unit 14 to dispense the coins out od the coin containing cylinder B.

Similarly as in the above-described cases, whenever the inventory switch 22 is operated under the condition that the condition of the EXCLUSIVE OR circuit 24 is satisfied, the data shifting operation is effected in the shift register 11, so that the single signal "0" is shifted successively as shown in the columns "periods $T_4$ through $T_7$" of FIG. 7. When the single signal "0" is shifted to the fourth stage SD4, the coin dispensing operation of the coin containing cylinder B, which is carried out during the period $T_3$, is suspended. When the single signal "0" is shifted to the fifth stage SD5, the signal "0" is supplied through a line 25C to the dispensation switching unit 14 to dispense the coins from the coin containing cylinder C. When the signal "0" is shifted to the sixth stage SD6, the coin dispensing operation of the coin containing cylinder C is suspended. Finally when the signal "0" is loaded in the seventh stage SD7, the signal "0" is supplied through a line 25D to the dispensation switching unit 14 to dispense the coins out of the coin containing cylinder D. Thereafter, by operating the inventory switch 22, the signals "1" are loaded in all the stages SD1 through SD7 of the shift register 11; that is, the shift register 11 is reset.

In the above-described manner, the coins are successively dispensed out of the coin containing cylinders A through D. As is apparent from the above description, in order to clear the contents of the shift register 11 it is necessary to operate the inventory switch 22 eight (8) times. Accordingly, if the inventory switch 22 is operated only four (4) times, the signal "0" is maintained loaded in the fourth stages SD4. Accordingly, the sale start signal SS which is raised to "1" when the vending machine is selling its commodities, and the coin return signal SR which is raised to "1" when the inserted coin returning switch of the vending machine are applied to the NOR circuit 28 so that the shift register 11 is cleared when the commodity selling operation or the coin returning operation is carried out. In the normal inventory operation, these signals SS and SR are at "0", and therefore the output of the NAND circuit 17 is at "0". In the commodity selling operation or in the coin returning operation, the sale start signal SS or the coin return signal SR is raised to "1", and the output of the NOR circuits 28 is set to "0". As a result, the output of the NAND circuit 17 is raised to "1". The output "1" of the NAND circuit 17 is applied through the inverter 18 to the NAND circuit 19, and therefore the output (DI) of the NAND circuit 19 is raised to "1". On the other hand, the output "1" of the NAND circuit 17 is applied through the OR circuit 20 to the NAND circuit 21, and therefore the data shifting operation is successively carried out with the timing of the working pulse WP. Thus, finally all the stages SD1 through SD7 of the shift register 11 have the signals "1"; that is, the shift register 11 is cleared.

Figure 8:
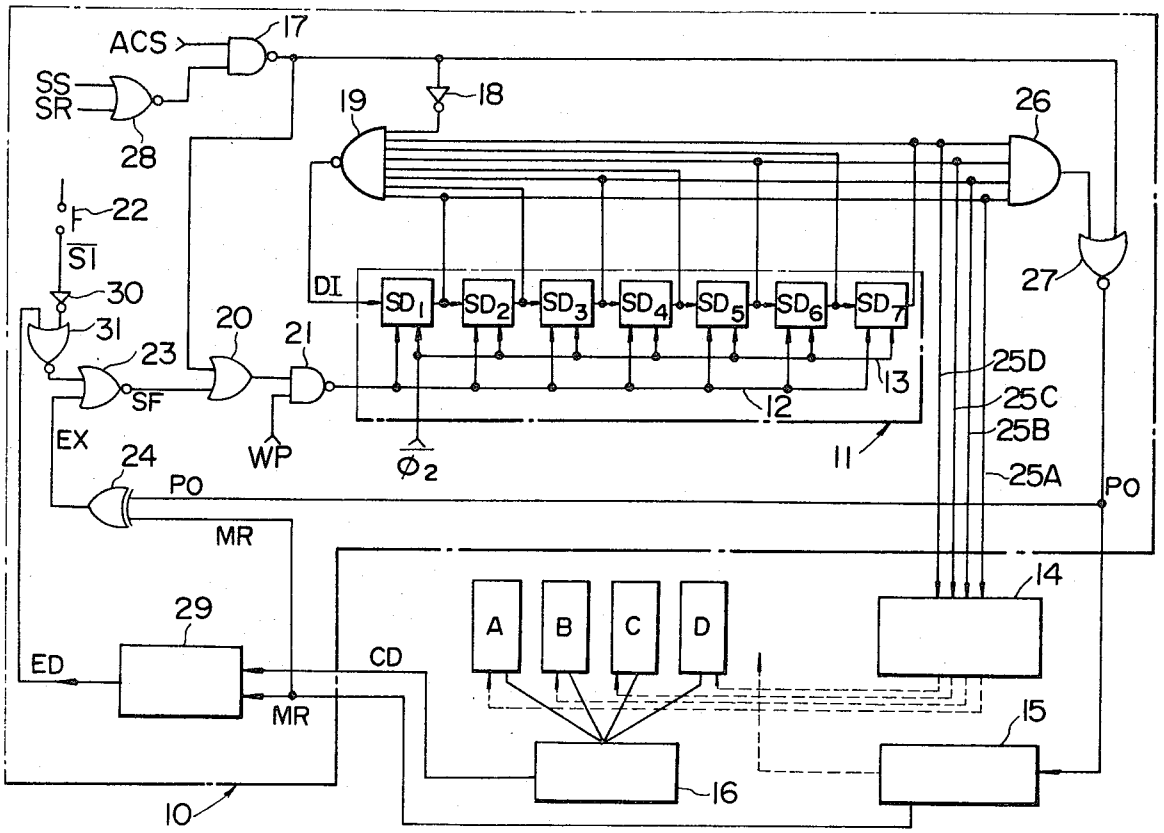
FIG. 8 is a circuit diagram, partly as a block diagram, showing another concrete example of the inventory device according to the invention.

FIG. 8 shows another example of the inventory device according to this invention. In FIG. 8, those components which have been described with reference to FIG. 5 are accordingly designated by the same reference numerals or characters.

In the inventory device shown in FIG. 8, the dispensation of all the coins in the coin containing cylinders is detected thereby to suspend the coin dispensing operation.

The inventory device 10 in FIG. 8 has an idling detecting section 29 which is adapted to detect the idling of the coin dispensing motor 15 (i.e. the fact that all the coins of the coin containing cylinders have been dispensed). The idling detecting section 29 receives the motor rotation signal MR from the coin dispensing motor 15 and a coin detecting signal CD from the dispensed-coin detecting section 16. When the coin dispensing motor 15 is rotating (i.e. the signal MR is at "1") and no coin is detected by the coin detecting section 16 (i.e. the coin detection signal CD is at "0"), the idling detecting section 29 outputs an idling detection signal ED (i.e. the signal ED is raised to "1").

When the inventory switch 22 is firstly depressed, the inventory signal SI is set to "0". This signal SI is applied through an inverter 30 to a NOR circuit 31. Therefore, the output of the NOR circuit 31 is set to "0". The output "0" of the NOR circuit 31 is applied to the NOR circuit 23. In the normal operation, initially the coin dispensation instruction signal PO and the motor rotation signal MR are at "0", and therefore the output EX of the EXCLUSIVE OR circuit 24 is at "0", and the output SF of the NOR circuit 23 is at "1". Accordingly, similarly as in the above-described case, the single signal "0" is loaded into the first stage SD of the shift register 11. As a result, the coin dispensing motor 15 is turned to dispense the coins out of the coin containing cylinder A. While the coins are being dispensed out of the coin containing cylinder A, the coins thus dispensed are detected by the dispensed-coin detecting section 16, and therefore the output ED of the idling detecting section 29 is at "0". When all the coins have been dispensed out of the coin containing cylinder A, no coin is detected by the dispensed-coin detecting section 16, and therefore the coin detection signal CD is set to "0". In this operation, the motor 15 is still maintained rotated, and therefore the condition of the idling detecting section 29 is satisfied, and the idling detection signal is at "1". This idling detection signal "1" is applied to the NOR circuit 31, so that the output of the NOR circuit 31 is set to "0". In this case, both the coin dispensation instruction signal PO and the motor rotation signal MR are at "1" while the output EX of the EXCLUSIVE OR circuit 24 is at "0". Accordingly, in response to the idling detection signal ED, the output SF of the NOR circuit 23 is raised to "1", and therefore the data held in the shift register 11 are shifted by one stage, respectively; that is the single signal "0" is shifted from the first stage SD1 to the second stage SD2. As a result, the coin dispensation instruction signal PO is set to "0" to stop the dispensing motor 15. Thus, the coin dispensing operation is automatically suspended.

When the inventory switch 22 is operated again, the single sinal "0" is shifted from the second stage SD2 to the third stage SD3 in the shift register 11, so that the coins are dispensed from the coin containing cylinder B. The coin dispensing operation of the coin containing cylinder B is automatically suspended in response to the idling detection signal ED, similarly as in the case of the coin containing cylinder A.

The operations concerning the remaining coin containing cylinders C and D are the same as those described above with reference to the cylinders A and B.

As is apparent from the above description, in the inventory device according to the invention, a plurality of coin containing cylinders can be operated with only one inventory switch, which contributes to a reduction of the switch mounting space, miniaturization of the device and a reducion of the manufacturing cost. Furthermore, merely by repeatedly operating one inventory switch, the coins are successively dispensed out of the coin containing cylinders, and therefore the inventory operation can be readily achieved, and the coins can be positively dispensed.

In addition, according to the invention, only when coin dispensation satisfies the predetermined conditions, the operation of the inventory switch is made effective. Therefore, no erroneous operations are caused; that is, the inventory operation is positively carried out. In other words, the data shifting operation in the shift register is never advanced erroneously by the chattering of the inventory switch.

This will be described in more detail. If chattering took place with the inventory switch 22, may inventory signals $\overline{SI}$ would be provided by one switch operation. However, the data in the shift register 11 are shifted by one stage in response to the firstly (or initially) produced inventory signal $\overline{SI}$, and at the same time the level of the coin dispensation instruction signal PO is changed from "1" to "0" or from "0" to "1", and in response to this change the state of the coin dispensing motor 15 is changed from rotation to stop or from stop to rotation. Since the operation of the motor 15 is started with delay, the motor rotation signal MR is not changed simultaneously when the coin dispensation instruction signal PO is changed. Accordingly, for a short period of time after one shift operation in the shift register 11, the two inputs PO and MR to the EXCLUSIVE OR circuit 24 are at "0" and "1", or "1" and "0", respectively. Accordingly, for the short period of time, the output of the Exclusive OR circuit 24 is maintained at "1", and therefore the output SF of the NOR circuit 23 is forcibly held at "0", so that the inventory signal $\overline{SI}$ is cancelled. That is, the inventory signal $\overline{SI}$ provided by the chattering of the inventory switch 22 is not handled as an effective one. Thus, the data in the shift register 11 are shifted by one stage only by one operation of the inventory switch, and the data will make no further shift by the chattering.

The invention has been described with reference to the case where the operation delay time of the motor 15 is longer than the chattering time of the switch 22. In the case where the former time is shorter than the latter time, the motor rotation signal MR is delayed by a suitable delay circuit (not shown) and is then applied to the EXCLUSIVE OR circuit 24. In this case also, the same effects can be obtained.

In this invention, the coin-dispensing-operation starting and suspended conditions are set by providing the EXCLUSIVE OR circuit 24. However, in the case where a shift register and one inventory switch are merely provided, unlike the invention, the data shifting operation is advanced erroneously in the shift register by the chattering of the inventory switch. This difficulty can be completely eliminated by providing the EXCLUSIVE OR circuit 24 and its relevant circuits according to the invention.

What is claimed is:

1. An inventory device in an automatic vending machine which comprises:

a shift register in which a single signal "1" is shifted successively in response to the operation of one inventory switch; and coin delivering means for controlling, in response to a bit output of said shift register, the coin dispensation of a corresponding coin containing cylinder, whereby coins contained in a plurality of coin containing cylinders are dispensed by the operation of said one inventory switch.

2. An inventory device as claimed in claim 1, which further comprises: display means for displaying, in response to a bit output of said shift register, a corresponding coin containing cylinder.

3. An inventory device in an automatic vending machine having a plurality of coin containers, which comprises:

an inventory switch;

control means for successively allowing said plurality of coin containers one after another to dispense coins to suspend the dispensation of coins in response to operation of said inventory switch; and a logic circuit for setting conditions when said control means operates to stop the coin dispensation of a coin container and when said control means operates to allow another coin container to dispense coins.

4. An inventory device as claimed in claim 3, in which said control means includes a control circuit which causes a coin container to dispense coins in response to operation of said inventory switch and automatically suspend the coin dispensation of said coin container when said coin container is emptied.

* * * * *